US008197204B2

(12) United States Patent
Aschermann et al.

(10) Patent No.: US 8,197,204 B2
(45) Date of Patent: Jun. 12, 2012

(54) FAN SYSTEM, HEAT EXCHANGER MODULE, METHOD FOR MANUFACTURING A FAN SYSTEM AND/OR A HEAT EXCHANGER MODULE

(75) Inventors: Uwe Aschermann, Karlsruhe (DE); Michael Spieth, Gomaringen (DE); Ulrich Vollert, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 959 days.

(21) Appl. No.: 12/158,644

(22) PCT Filed: Dec. 22, 2006

(86) PCT No.: PCT/EP2006/012430

§ 371 (c)(1),
(2), (4) Date: Aug. 27, 2008

(87) PCT Pub. No.: WO2007/076972

PCT Pub. Date: Jul. 12, 2007

(65) Prior Publication Data

US 2008/0308261 A1 Dec. 18, 2008

(30) Foreign Application Priority Data

Dec. 23, 2005 (DE) ..... 10 2005 062 668

(51) Int. Cl.
*F24H 3/02* (2006.01)
*F04D 29/52* (2006.01)
*B23P 15/00* (2006.01)

(52) U.S. Cl. ..... 415/223; 165/121; 29/888.025

(58) Field of Classification Search ..... 415/223; 165/121; 29/888.025
See application file for complete search history.

(56) References Cited

U.S. PATENT DOCUMENTS

| | | | | |
|---|---|---|---|---|
| 2,616,662 | A | 11/1952 | Mierley | |
| 2,874,898 | A | 2/1959 | Bayhi | |
| 3,237,849 | A | 3/1966 | Krell | |
| 4,548,548 | A | 10/1985 | Gray, III | |
| 5,758,716 | A | 6/1998 | Shibata | |
| 6,024,536 | A | 2/2000 | Tsubakida et al. | |
| 6,561,762 | B1 | 5/2003 | Horng et al. | |
| 7,377,098 | B2 * | 5/2008 | Walker et al. | 60/39.08 |
| 2005/0163614 | A1 * | 7/2005 | Chapman | 415/206 |
| 2010/0236217 | A1 * | 9/2010 | Venkataramani et al. | 60/266 |

FOREIGN PATENT DOCUMENTS

| | | | |
|---|---|---|---|
| DE | 41 05 378 | A1 | 8/1992 |
| DE | 195 13 135 | A1 | 10/1996 |
| DE | 196 38 518 | A1 | 4/1998 |
| DE | 197 51 042 | C2 | 5/1998 |
| DE | 199 48 074 | A1 | 4/2000 |
| DE | 101 09 621 | A1 | 9/2002 |
| DE | 202 14 973 | U1 | 11/2002 |
| DE | 203 12 448 | U1 | 10/2003 |

(Continued)

*Primary Examiner* — David S Blum
(74) *Attorney, Agent, or Firm* — Foley & Lardner LLP

(57) ABSTRACT

Fan system, in particular for a heat exchanger, which fan system has at least one receptacle for a fan drive unit, at least one housing wall, and at least one strut, in particular a number of struts which connect the receptacle to the housing wall, wherein the struts are arranged between at least one heat exchanger and at least one fan wheel, wherein at least one strut has a strut end section which is configured as a flow guiding face and has an angle α with respect to a fan-wheel axis direction.

12 Claims, 8 Drawing Sheets

FOREIGN PATENT DOCUMENTS

Figure 2:
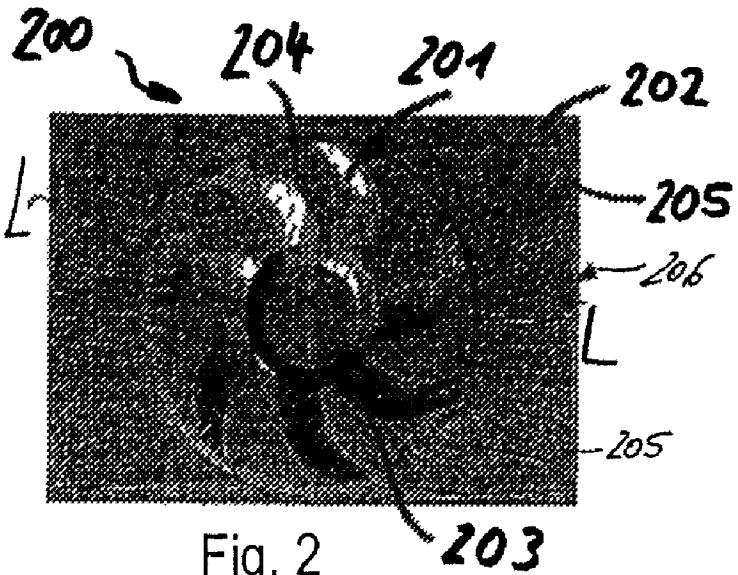

| | | | |
|---|---|---|---|
| DE | 103 58 917 | A1 | 12/2004 |
| EP | 1 016 791 | A2 | 7/2000 |
| GB | 461345 | | 2/1937 |
| GB | 2 344 619 | A | 6/2000 |

* cited by examiner

FAN SYSTEM, HEAT EXCHANGER MODULE, METHOD FOR MANUFACTURING A FAN SYSTEM AND/OR A HEAT EXCHANGER MODULE

RELATED APPLICATIONS

This application is a 371 of PCT/EP06/12430, filed Dec. 22, 2006.

The invention relates to a fan system, in particular for a heat exchanger to a heat exchanger module, and to a method for manufacturing a fan system and/or a heat exchanger module.

Fan systems are used in connection with heat exchangers for sucking in a media stream, in particular a cooling air stream, which flows through the heat exchanger. Particularly in heat exchangers and heat exchanger modules for motor vehicles, the maximum possible mass airflow is to be routed through the heat exchanger or the heat exchanger module at all the operating points of the motor vehicle, in order, particularly in the critical part load ranges, to achieve a sufficient cooling capacity. In these critical part load ranges, the dynamic pressure generated by the travel of the vehicle is not sufficient for the flow through the heat exchanger or the heat exchanger module. For this reason, a fan system, which is arranged upstream or downstream of at least one heat exchanger is used. The fan may be driven, for example, by an electric motor or a vehicle-driven shaft. In this case, the shaft driven by the vehicle engine may be connected to the fan of the fan system rigidly or via what is known as a Visco® coupling. A combination of the various drive possibilities for the fan is also possible. A fan system may have one fan wheel or a plurality of fan wheels. The fan wheel and/or the airflow of the air through the fan wheel and the fan housing generate/generates a noise which is perceived by the driver and is often felt to be disturbing. The flow turbulences which occur particularly during the flow through the fan wheel and/or the fan housing constitute a further source of noise.

An axial fan, in particular for conveying air through the heat exchanger of a motor vehicle, is known from DE19638518A1. The axial fan has a multiplicity of struts extending between an inner holding element and a supporting ring. For aerodynamic and acoustic optimization, the struts have an aerodynamic profile which may be designed symmetrically or asymmetrically. The struts between an inner holding element and an outer supporting ring are inclined radially or else at an acute angle with respect to the radial direction to the fan axis. Furthermore, the struts may also be curved arcuately. The middle strut of one group is at an angular distance of 90° from the middle strut of an adjacent group and in each case an angular distance of 15° from the two adjacent struts. The middle struts have an angular distance of 450 with respect to the main load direction.

Furthermore, an axial fan, in particular for conveying air through an engine cooler of a motor vehicle is known from DE4105378A1. The axial fan has a fan wheel, an electric motor driving this and an air guide element following the fan wheel in the airflow direction and having a multiplicity of struts for air conduction which extend transversely with respect to the airflow. To avoid an excessive generation of noise, in particular of siren-like noises, the struts running from an inner mounting for the electric motor to an outer supporting ring are inclined at an acute angle with respect to the radial direction to the fan axis. The inclination angle of the struts for air conduction, as seen in the direction of rotation of the fan wheel, amounts to approximately 20°.

Furthermore, a fan with a housing for air routing, which routes air through a heat exchanger, is known from U.S. Pat. No. 4,548,548.

The object of the present invention is to improve a fan system, in particular for a heat exchanger.

This object is achieved, in one embodiment, by a fan system, in particular for a heat exchanger, with at least one receptacle for at least one fan drive unit for driving at least one fan wheel, with at least one housing wall, and with at least one strut, in particular with a number of struts which connect the receptacle to the housing wall, the struts being capable of being arranged between at least one heat exchanger and the at least one fan wheel, at least one strut having at least one strut portion which is designed as a flow guide surface and which has an angle $\alpha$ with respect to a fan wheel axis direction LRA. A "flow guide surface" is to be understood, in particular, to mean that the strut is designed and arranged in such a way that it runs and/or is arranged essentially in a direction which corresponds essentially to the direction of the airflow, in a region upstream of the strut, as seen in the airflow direction, there still essentially being no disturbing influences on account of the strut in this region.

The fan system may have, in particular, a fan wheel, a fan housing with at least one housing wall, a drive unit, in particular an electric drive unit. The fan system may, in particular, a heat exchanger, such as, for example, a coolant cooler and/or a charge air cooler and/or an exhaust gas cooler and/or an oil cooler and/or a condenser for an air-conditioning system and/or a gas cooler for an air conditioning system, and have flowing through it a medium, in particular a cooling medium, such as, for example, air. The receptacle for an air drive unit, in particular an electric drive unit, such as, for example a motor, is connected by means of at least one strut to a housing wall of a fan housing, in particular by means of a plurality of struts. The receptacle may be, in particular, an element in which a fan drive unit, such as, for example, a motor unit, is arranged. At least one strut, in particular a plurality of struts, have at least one strut portion which has an angle $\alpha$ with respect to a fan wheel axis direction (LRA) and is designed as a flow guide surface. The strut portion, in particular the flow guide surface of the strut, may in this case, in particular, have a profile which may be of streamlined, in particular aerodynamic and/or fluid-dynamic design. Thus, in particular, a medium in particular cooling medium, flowing past the at least one strut can flow past essentially without turbulences and/or frictional losses. In particular, the noise which is generated due to the disturbance of the flow medium flowing past the at least one strut can thereby be reduced. The fan wheel axis direction is in this case, in particular, the direction which runs in the direction of the axis of the fan wheel.

In an advantageous development, at least one housing orifice is arranged eccentrically with respect to the at least one housing. The housing orifice is in this case particularly advantageously not arranged in the middle or not centrally with respect to the housing, but instead is advantageously located outside the middle of the housing.

In an advantageous embodiment, the at least one housing orifice is arranged centrally with respect to the at least one housing. In particular, the orifice is arranged essentially at the center of the housing and leads to a particularly advantageous flow through the housing of the medium flowing through, such as, for example, air.

In a further advantageous version, at least one strut portion of at least one strut has an angle $\beta$ with respect to a plane which is formed by a direction radial to the fan wheel axis direction LRA and by the fan wheel axis direction LRA.

Particularly advantageously, turbulences of the medium, in particular air, flowing past the strut or the strut portion can be prevented.

Furthermore, a fan system is proposed, characterized in that a strut end portion of at least one strut is designed as a web-like projection, in such a way that the strut end portion has an angle γ with respect to a plane which is formed by a direction radial to the fan wheel axis direction LRA and by the fan wheel axis direction LRA. In particular, the strut end portion, in particular the end of the strut, has a profile which is of aerodynamic and/or fluid-dynamic design, so that, when a medium flows past the strut end portion, essentially no or only little turbulences are formed. Thus, frictional losses when the medium flows past the strut end portion and/or the generation of noise can be reduced.

In an advantageous development, the housing wall has in each case at least one cutout adjacent to at least one strut end portion. Particularly in the portion in which a strut end portion of the strut is connected to the housing, a cutout is introduced into the housing wall, in particular essentially directly adjacently to the strut end portion, so that a flow medium, after it has flowed past the strut, passes through the cutout.

In a further version, the strut end portion has a clearance with respect to a housing wall portion. Particularly advantageously, flow turbulences and noises when the flow medium flows past the strut can be reduced, in that a clearance is formed between that portion of the housing wall in which the strut is connected to the housing wall and an orifice in the housing wall. By means of this clearance, flow losses of the medium flowing past the strut, in particular the struts, and also noises occurring in this case can be reduced particularly advantageously.

In a development, the strut end portion is arranged flush with the housing wall portion.

In a further design, at least one strut end portion has at least one flow guide element. In particular, the flow guide element may have an aerodynamic or fluid-dynamic form, so that, when the medium flows past the strut, frictional losses and/or turbulences and noises possibly resulting from these are reduced particularly advantageously. Furthermore, the flow guide element may, in particular, be formed in one piece with the strut end portion.

Furthermore, a heat exchanger module with at least one heat exchanger and with at least one fan system is proposed. Particularly advantageously, the heat exchanger module has at least one heat exchanger, in particular a number of heat exchangers, such as, for example a coolant cooler and/or charge air cooler and/or exhaust gas cooler and/or a condenser of an air conditioning system and/or an evaporator of an air conditioning system and/or an oil cooler and/or a gas cooler of an air conditioning system. Moreover, the fan system may have a fan wheel, a drive unit for the fan wheel, in particular an electric drive unit, and a fan housing with at least one housing wall.

Furthermore, a method for manufacturing a fan system and/or a heat exchanger module is proposed, the fan system being manufactured by means of a forming manufacturing method, in particular by injection molding such as, for example, plastic injection molding. The fan system and/or the heat exchanger module can thereby be manufactured particularly advantageously and cost-effectively.

Further advantageous embodiments may be gathered from the subclaims and from the drawing.

Figure 1:
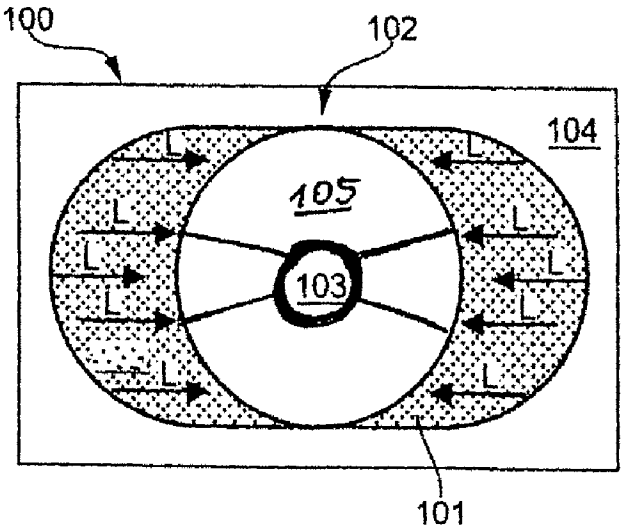
Figure 3:
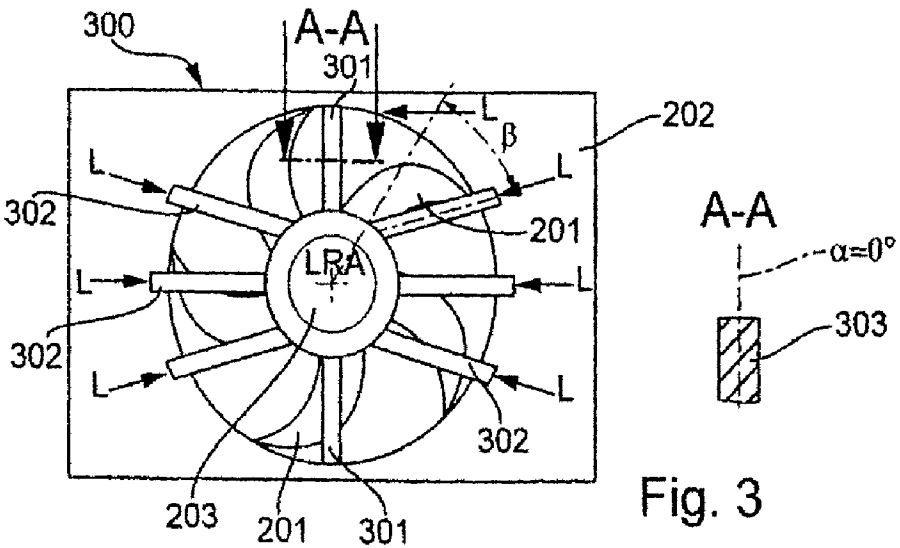
Figure 4:
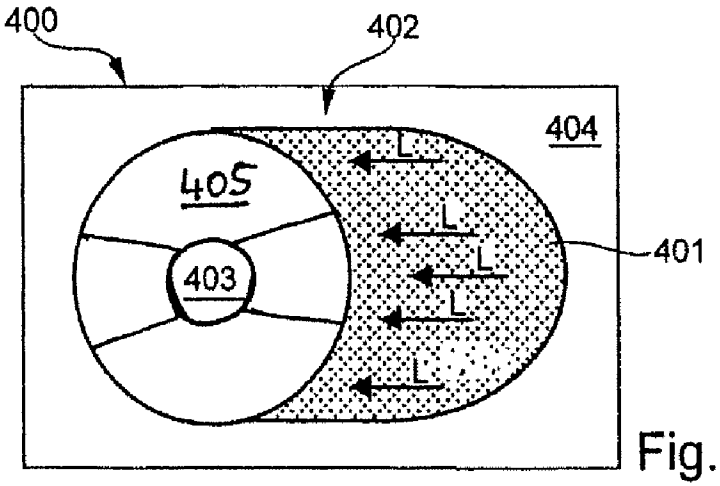
Figure 6:
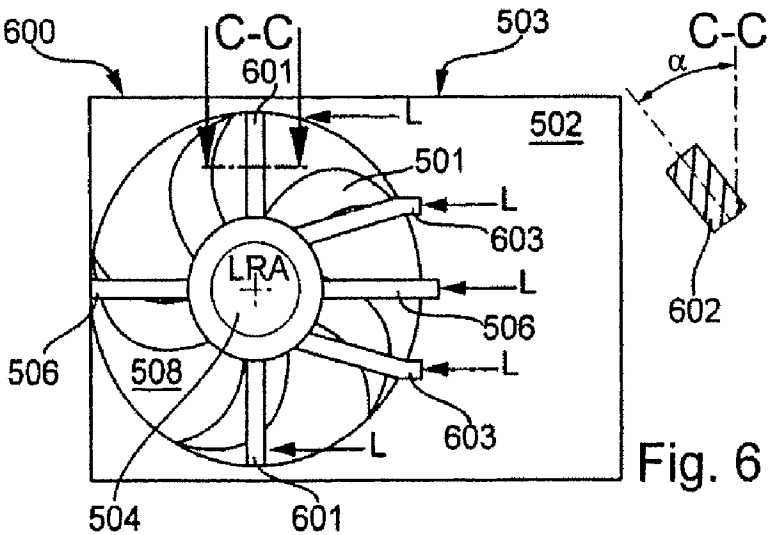
Figure 5:
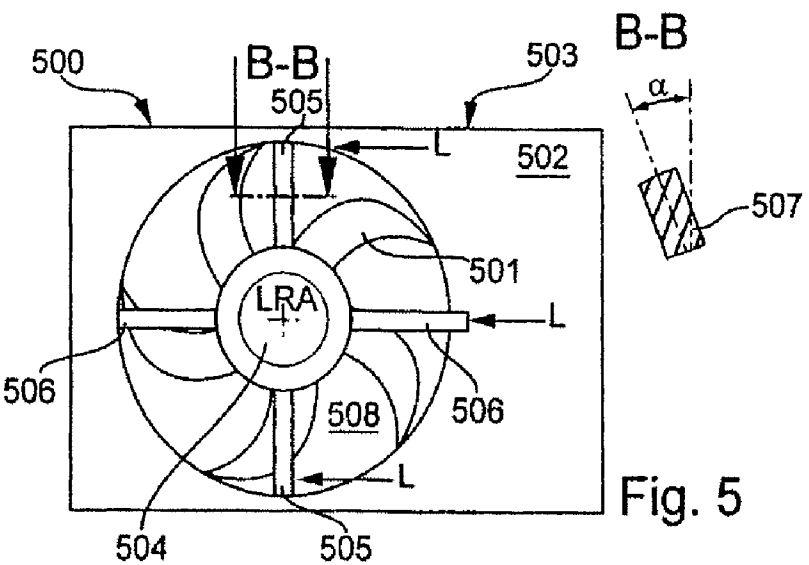
Figure 7:
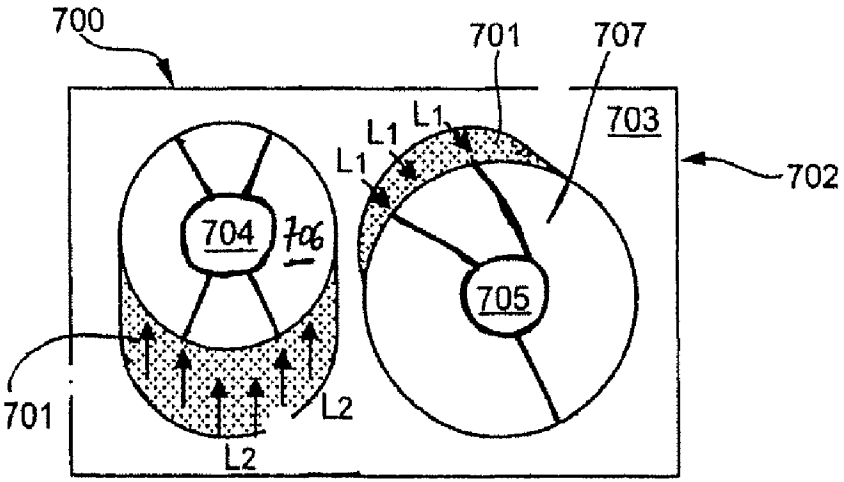
Figure 8:
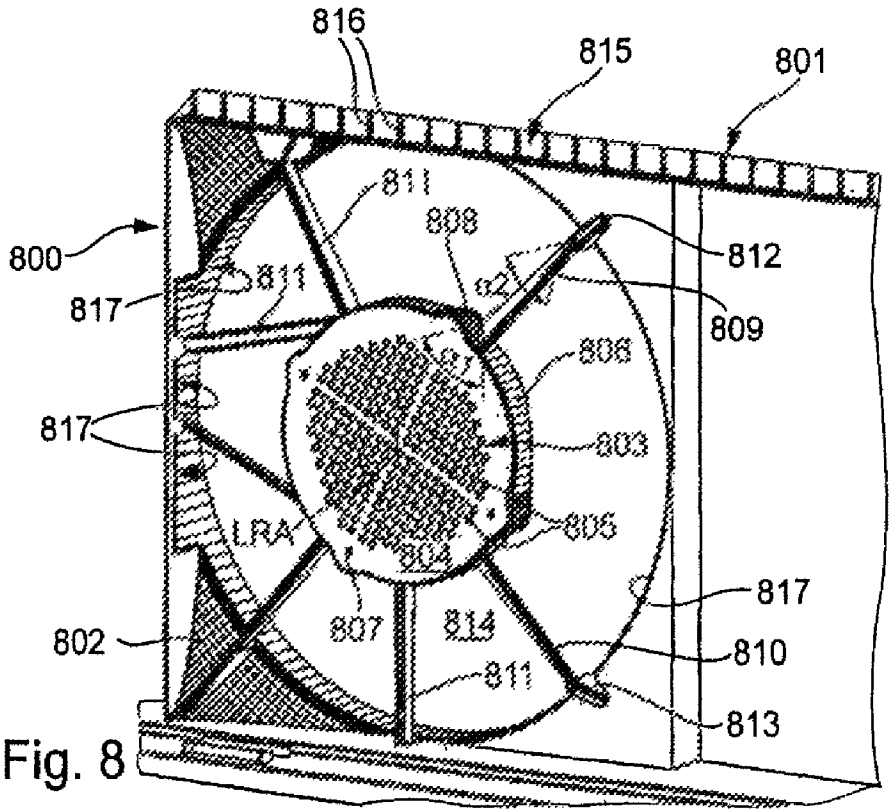
Figure 11:
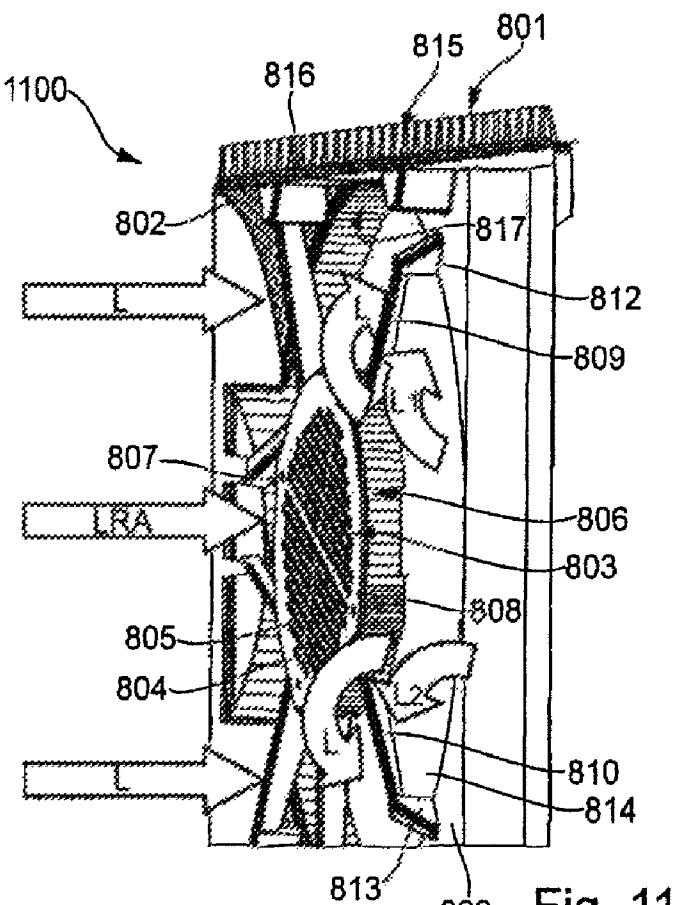
Figure 9:
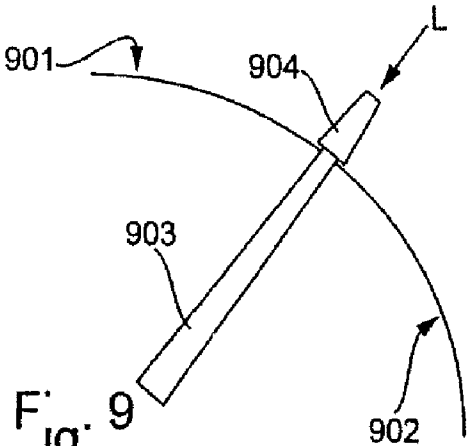
Figure 10:
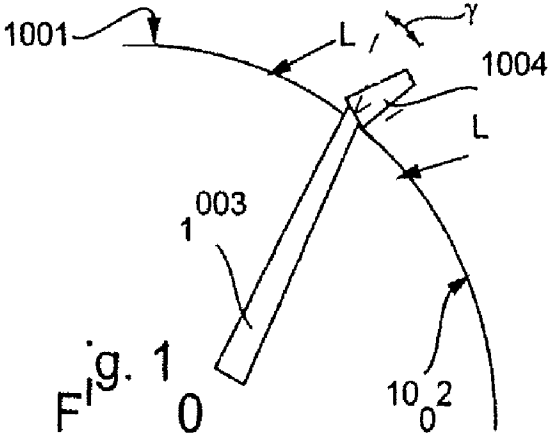
Figure 12:
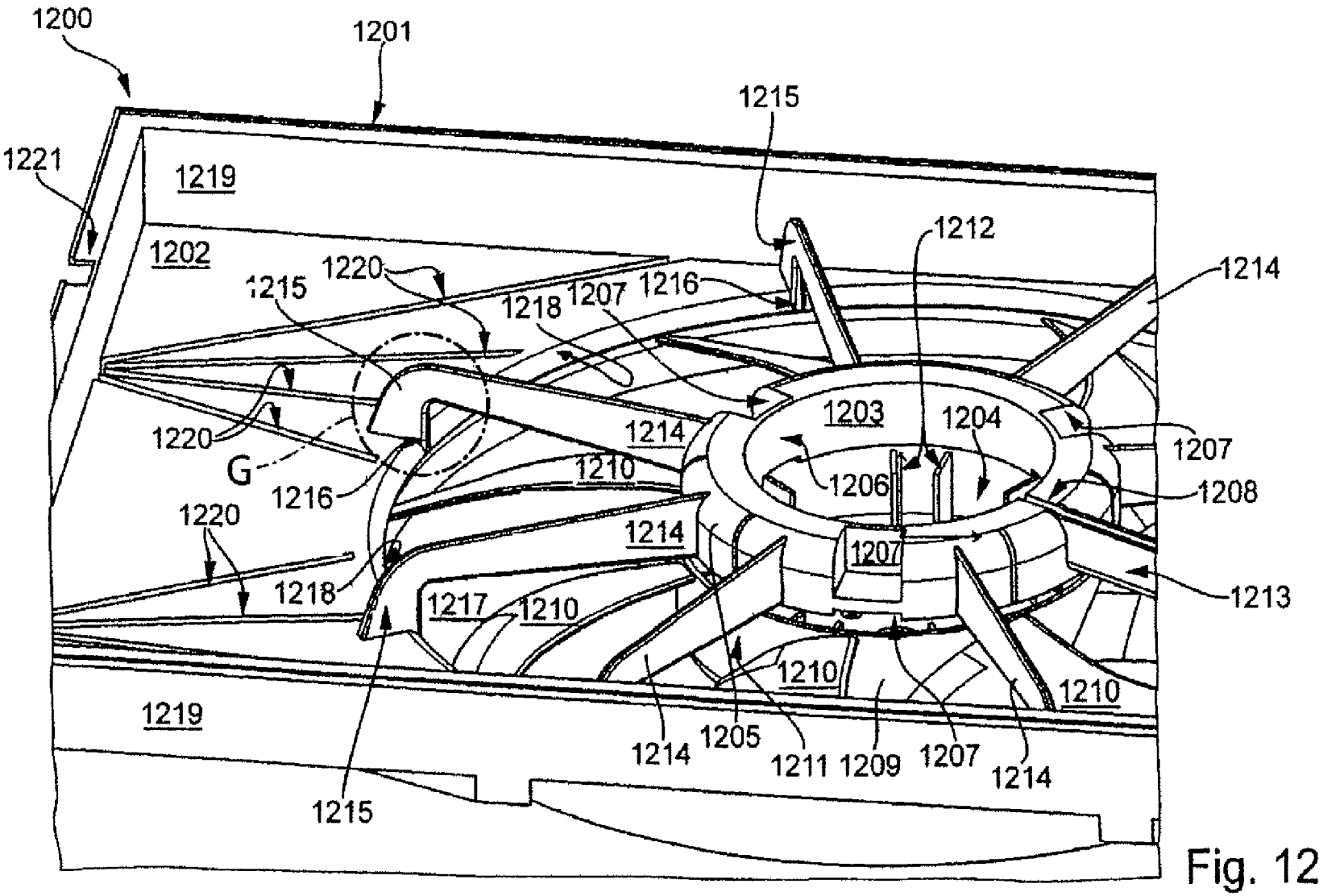
Figure 13:
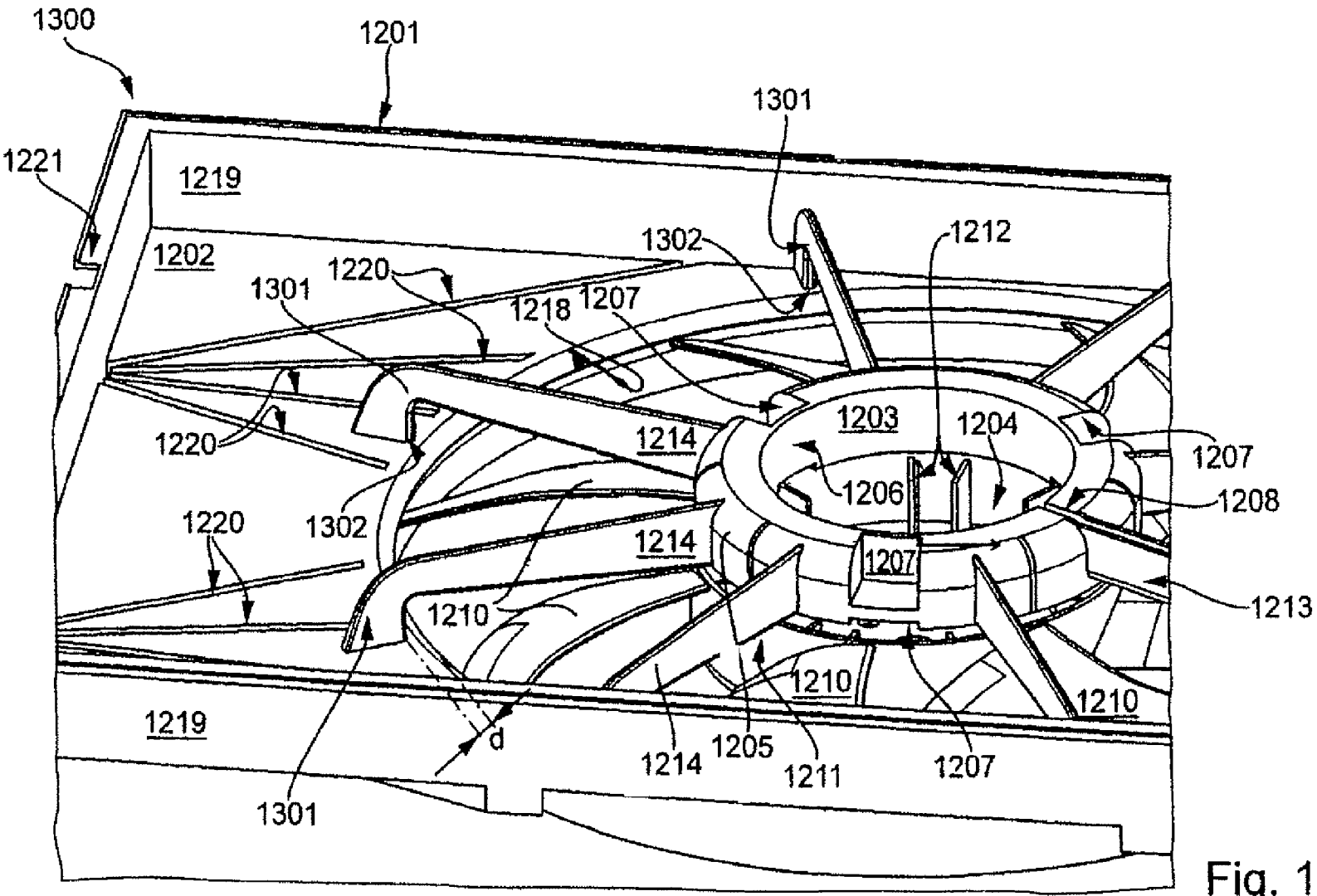
Figure 14:
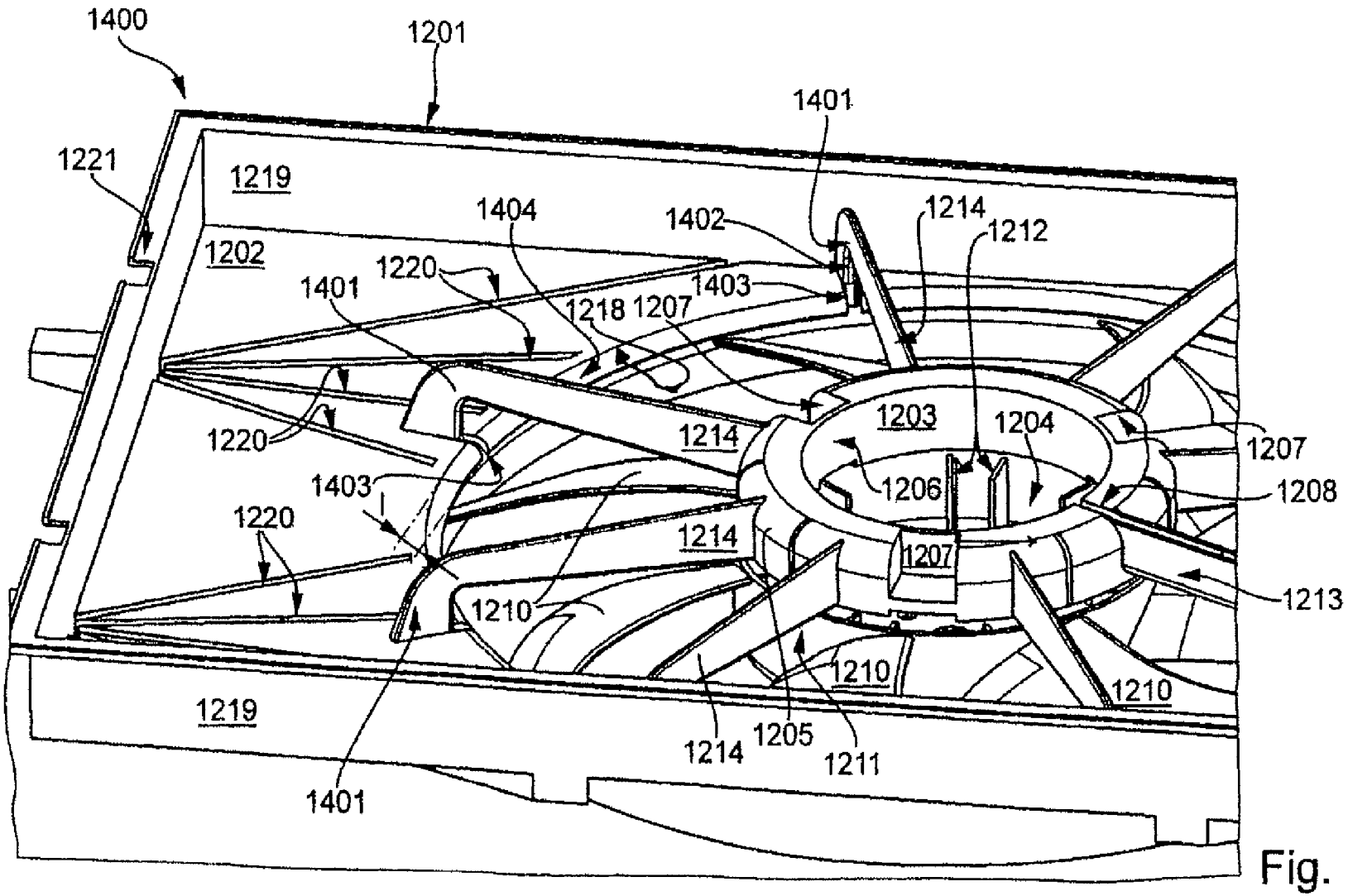
Figure 15:
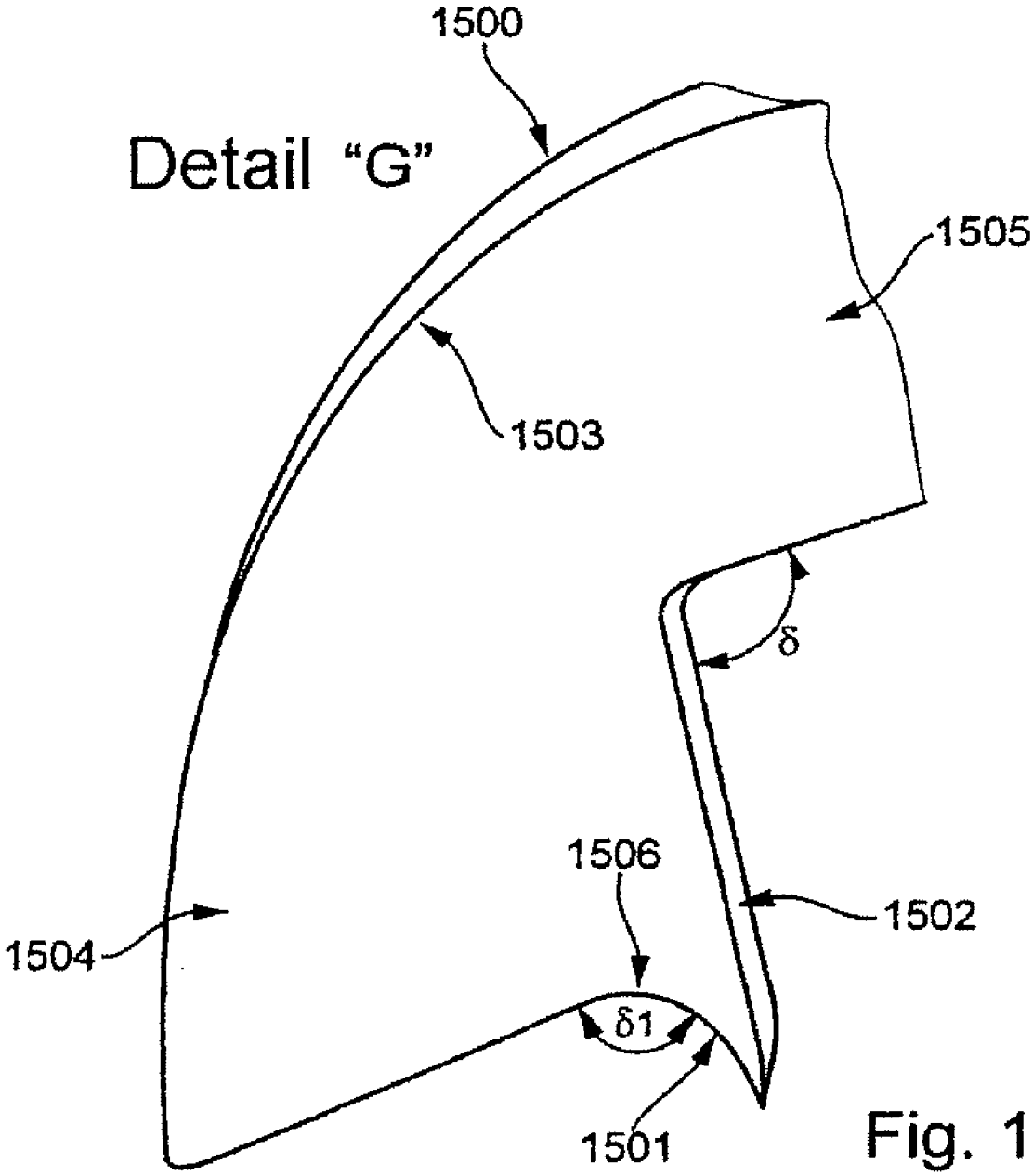

Exemplary embodiments of the invention are illustrated in the drawing and are explained in more detail below. In the drawing:

FIG. 1 shows a basic illustration of a fan system with a housing orifice arranged centrally in the housing, with the zone of the main fraction of the mass airflow being illustrated, FIG. 2 shows an illustration of a fan system with a centrally arranged fan and with a flow medium in a streamlined illustration, FIG. 3 shows another basic illustration of a fan system with a centrally arranged fan wheel and a sectional illustration A-A through a strut with an angle $\alpha=0°$ with respect to the fan wheel axis direction, FIG. 4 shows a basic illustration of a fan system with an eccentrically arranged housing orifice, with the zone of the main fraction of the mass airflow being illustrated, FIG. 5 shows another basic illustration of a fan system with an eccentrically arranged housing orifice and a sectional illustration B-B through a strut with an angle $\alpha>0°$, FIG. 6 shows a further basic illustration of a fan system with an eccentrically arranged housing orifice and a sectional illustration C-C through a strut with an angle $\alpha>0°$, FIG. 7 shows a basic illustration of a fan system with two eccentrically arranged housing orifices, with the zone of the main fraction of the mass airflow being illustrated, FIG. 8 shows a fan housing with an eccentrically arranged housing orifice and with a receptacle for the fan drive unit, FIG. 9 shows a basic illustration of a strut, the strut end portion of which has the angle $\beta=0°$, FIG. 10 shows a basic illustration of a strut, the strut end portion of which has the angle $\beta>0°$, FIG. 11 shows a perspective view of a fan housing of a fan system, FIG. 12 shows a perspective view of a fan housing of a fan system with struts, the strut end portions of which are formed in one piece with a flow guide element, FIG. 13 shows a perspective view of a fan housing of a fan system, the struts of which have a clearance with respect to a housing wall portion, FIG. 14 shows a perspective view of a fan housing of a fan system, the housing wall of which has in each case a cutout adjacent to the strut end portions of the struts and FIG. 15 shows, as a detail, an illustration of a strut end portion which is formed in one piece with a flow guide element.

FIG. 1 shows a basic illustration (rear view) of a fan system 100 with a centrally arranged receptacle 103 for a fan drive unit. The fan system 100 has a housing 102. The housing 102 has at least one housing wall 104, into which an orifice 105, in particular a circular orifice, is introduced. The housing 102 and/or the housing wall 104 are produced from a material which has low density, in particular from plastic. The dotted area 101 illustrates essentially the region of the main fraction of the mass airflow. When the fan is in operation, the airflow is essentially in the direction L to the orifice 105. A heat exchanger, not illustrated, may be arranged adjacently to the housing 102, in particular so as to be oriented essentially parallel thereto. In another version, at least one further heat exchanger may be arranged adjacently to the heat exchanger, not illustrated, and essentially parallel to the first heat exchanger. The heat exchanger and/or the other heat exchangers arranged essentially adjacently to this may, for example, be a coolant cooler and/or a charge air cooler and/or an exhaust gas cooler and/or an oil cooler and/or a condenser for an air conditioning system and/or a gas cooler for an air conditioning system.

A receptacle 103 for a fan drive unit is arranged, essentially adjacently to the housing 102 and/or to the housing wall 104, essentially in the middle of the housing 102, in particular centrally. The fan drive unit, not illustrated in any more detail, may be an electric motor. The receptacle 103 is connected in a way not illustrated to the housing 102 or to the housing wall 104. A medium, in particular a gaseous medium, such as, for example, air, is sucked through the heat exchanger, not illustrated, by a fan wheel, not illustrated. After flowing through the heat exchanger, the medium, in particular air, flows, essentially parallel to the heat exchanger, not illustrated, and/or essentially parallel to the housing wall 104, in the media flow direction L, before the medium passes through the orifice 105 in the housing wall.

FIG. 2 shows an illustration of fan system 200 with a fan wheel 201 arranged essentially symmetrically and/or centrally with respect to the housing 206 of the fan system 200.

The housing 206, in particular produced from plastic, has at least one housing wall 202. The housing wall 202 is of essentially rectangular design. In another version, not illustrated, the housing wall has an essentially circular, oval or any other desired shape. The housing wall 202 has an orifice 204. In another embodiment, the housing wall has two, three or more orifices which are designed essentially circularly or in the form of a long hole or ovally or rectangularly or as a combination of the shapes mentioned. A fan wheel 201 is arranged essentially adjacently to the housing wall 202 and essentially parallel to the housing wall 202. The fan wheel 201 has essentially sickle-shaped vanes, not designated in any more detail. In the exemplary embodiment illustrated, the fan wheel has seven vanes. In another exemplary embodiment, not illustrated, the fan wheel may have more or less than seven vanes. The receptacle 203 for the fan drive unit is produced essentially from the same material as the housing wall 202. In particular, the receptacle for the fan drive unit, in particular an electric motor, is connected to the housing wall 202 in a way not illustrated. The receptacle 203 is arranged essentially concentrically with respect to the orifice 204. The flow of the medium, in particular air is illustrated by a number of flow lines 205. The medium, in particular the gaseous medium, such as, for example, air, flows essentially parallel to the housing wall 202. In an orifice portion, not designated in any more detail, of the orifice 204 in the housing wall 202, the medium L flows essentially radially with respect to the housing orifice 204 and passes through the orifice 204 in the direction of a fan wheel axis, not designated in any more detail.

FIG. 3 shows a basic illustration of a fan system 300 with a centrally arranged fan wheel. Identical features are designated by the same reference symbols as in the preceding figures.

The housing wall 202 is connected to the receptacle 203 by means of a number of first struts 301 and second struts 302. The cross section of the first strut 301 is designed essentially as a strut cross-sectional surface 303. The strut cross-sectional surface 303 is essentially rectangular. In another embodiment, it is of round or oval design or is designed with an aerodynamic shape. The second struts 302 likewise have essentially a strut cross-sectional surface 303. In another embodiment, they may have round, oval or other aerodynamic shapes. The first strut 301 has the angle $\alpha=0°$ to the fan wheel axis direction LRA. The second struts in each case have an assigned angle $\beta$ with respect to a direction radial to the fan wheel axis direction LRA, so that the second struts 302 are arranged in such a way that they run essentially parallel to the media flow direction L.

FIG. 4 shows a basic illustration of a fan system 400 with an eccentrically arranged housing orifice 405, with the zone of the main fraction of the mass airflow being illustrated. Identical features are given the same reference symbols as in the preceding figures, with one added.

The zone of the main fraction 401 of the mass airflow is illustrated as a dotted area, the area being designed essentially as a distorted crescent-shaped area.

The fan system 400 has a heat exchanger, not illustrated, in particular a number of heat exchangers, and is arranged essentially parallel to a housing wall 404 of the housing 402 of the fan system 400. The housing 402 is formed from a material with a low density, in particular from plastic, and has a housing wall 404. The housing wall 404 is produced from a material with low density, in particular from plastic. The housing 402 has a housing wall 404 with an orifice in the housing wall 404. The orifice 405 is of essentially circular design. In another version, not illustrated, the orifice 405 is of rectangular or round design or has a combination of the abovementioned shapes. The flow medium in particular air, flows through the heat exchanger, not illustrated, and, after flowing through the heat exchanger, not illustrated, flows essentially parallel to the housing wall 404 before it flows through the orifice 405. The receptacle 403 for the fan drive unit, in particular the motor unit of an electric motor is arranged essentially concentrically in the orifice 405. The receptacle 403 is connected in a way not illustrated to the housing 402 or to the housing wall 404 likewise by means of struts, not illustrated.

FIG. 5 shows another basic illustration of a fan system 500 with an eccentrically arranged housing orifice 508. Identical features are given the same reference symbols as in the preceding figures.

The fan system 500 has a heat exchanger, not designated in any more detail, in particular a number of heat exchangers, and also at least one fan wheel 501. Furthermore, the fan system 500 has a housing 503 with a housing wall 502. The housing 503 and/or the housing wall 502 are produced from a material with low density, in particular from plastic. The housing wall 502 has a housing orifice 508 in the housing wall. The orifice is of circular design. In another version, not illustrated, the orifice is designed to be oval, in the form of a long hole, rectangular or a combination of the shapes mentioned. A receptacle 504 for a fan drive unit, in particular an electric motor is arranged essentially concentrically to the orifice 508. The receptacle is connected to the housing wall 502 by means of first struts 505 and/or second struts 506. The first struts 505 and the second struts 506 are arranged essentially such that they are arranged essentially parallel to the media flow direction L of the flow medium, in particular the cooling air. Parallel to this at least one strut portion of the first struts 505 has an angle $\alpha$ with respect to the fan wheel axis direction LRA. The angle $\alpha$ assumes, in particular, values of 0° or 90° or values between 0° and 90°. Particularly advantageous are values of between 0° and 80° or of between 0° and 70° or of between 0° and 50° or of between 0° and 40° or of between 0° and 30° or of between 20° and 40° or of between 10° and 40° or of between 20° and 60° or of between 30° and 70°.

FIG. 6 shows a further basic illustration of a fan system 600 with an eccentrically arranged housing orifice. Identical features are given the same reference symbols as in the preceding figures.

The fan system 600 has first struts 601 which connect the housing wall 502 to the receptacle 504. Third struts 603 connect the housing wall 502 of the housing 503 to the receptacle 504 of the fan drive unit. At least one strut portion of the first strut 601 has an angle $\alpha$ with respect to the fan wheel axis direction LRA. In this case, the angle $\alpha$ of the first strut 601 is larger than the angle $\alpha$ of the first strut 505 of FIG. 5.

FIG. 7 shows a basic illustration of a fan system 700 for two fans, with a zone of the main fraction of the mass airflow being illustrated. Identical features are given the same reference symbols as in the preceding figures.

The fan system 700 has a housing 702 with a housing wall 703. The housing wall 703 has a first orifice 706 and a second orifice 707. The first orifice 706 is of essentially circular design. The second orifice is of essentially circular design.

The zones of the main fraction of the mass airflows which flow through the first orifice 706 and the second orifice 707 are essentially sickle-shaped or illustrated as a distorted crescent-shaped area.

A heat exchanger, not illustrated, is arranged essentially parallel to the housing wall 703. In another version, not illustrated, a second heat exchanger, not illustrated, or a multiplicity of heat exchangers, not illustrated, is or are arranged essentially adjacently to a first heat exchanger, not illustrated. The at least second heat exchanger is in this case arranged upstream or downstream of the first heat exchanger. In another version, the at least second heat exchanger is arranged next to the first heat exchanger.

The fan system 700 has a first receptacle 704 for a first fan drive unit, not illustrated, in particular first fan wheel drive unit, such as, for example, electric motor. Furthermore, the fan system 700 has a second receptacle 705 for a second fan drive unit, in particular fan wheel drive unit, such as, for example, an electric motor. The first receptacle 704 is connected to the housing wall 703 via struts in a way not illustrated. The second receptacle for the drive unit is connected to the housing wall 703 via struts in a way not illustrated. The fan housing 702 and the housing wall 703 are produced from a material with a low density, in particular from plastic. The struts, not illustrated, and the first receptacle 704 and the second receptacle 705 are preferably likewise produced from plastic. The housing 702 and/or the housing wall 703 and/or the first receptacle and/or the second receptacle are produced from another material, such as, for example, aluminum, or from another metal. The medium, in particular the cooling medium, in particular air, flows essentially in a first media flow direction L1 in the direction of the second orifice 707. The flow medium, in particular air, flows essentially in a second media flow direction L2 in the direction of the first orifice 706 of the housing wall 703.

The first receptacle 704 is of essentially annular design. The second receptacle 705 is of essentially annular design. The first receptacle 704 and/or the second receptacle 705 may, in another version, not illustrated, have an oval shape, a rectangular shape, a shape in the form of a long hole or a shape composed of a combination of the abovementioned shapes.

The first orifice 706 has a larger orifice area, not designated in any more detail, than the second orifice 707. In another exemplary embodiment, not illustrated, the first orifice has a smaller orifice area, not designated in any more detail, than the second orifice 707. In another exemplary embodiment, the first orifice 706 has the same orifice area, not designated in any more detail, as the second orifice 707.

FIG. 8 shows a fan system 808 with a fan housing 801. Identical features are given the same reference symbols as in the preceding figures.

The fan system 800 has a housing 801 with at least one housing wall 802. The housing wall 802 has a housing wall orifice 814. The housing wall orifice 814 is of essentially circular design. In another version, not illustrated, the housing orifice 814 is designed to be oval or rectangular or in the form of a long hole or a combination of the shapes mentioned. The housing 801 has a housing frame 815. The housing frame has a number of reinforcing elements 816, in particular reinforcing struts. The reinforcing struts are, in particular, produced in one piece with the housing frame.

The housing 801 and/or the housing wall 802 and/or the housing frame 815 and/or the reinforcing struts 816 are produced from a material with low density, in particular from plastic. The housing 801 and/or the housing wall 802 and/or the housing frame 815 are manufactured, in particular, by means of a forming manufacturing method, in particular by plastic injection molding. A first strut 809 and/or a second strut 810 and/or other struts 811 connect the receptacle 803 to the housing 801, in particular to the housing wall 802. The first strut 809 has a first strut end portion 812.

The first strut end portion 812 is a web-like projection and connects the first strut essentially to the housing wall 802. The first strut end portion 812 has, in particular, an aerodynamic and/or fluid-dynamic shape. The first strut end portion is designed in such a way that a medium flowing past, in particular air flowing past, experiences low frictional losses, and essentially no generation of noise occurs. For this purpose, the first strut end portion 812 is of essentially streamline design. In another version, the first strut end portion is designed as an essentially triangular body. Furthermore, however, in another embodiment, the first strut end portion may be designed as a body in the form of a segment of a circle.

The first strut 809 has at least in portions, in particular adjacently to the receptacle 803, an angle $\alpha 1$ with respect to the fan wheel axis direction LRA. The first strut 809 has, essentially adjacently to the first strut end portion 812, essentially an angle $\alpha 2$ with respect to the fan wheel axis direction LRA. The angle $\alpha 1$ is greater than the angle $\alpha 2$. The angle $\alpha 1$ can assume the values 0° or 70° or values of between 0° and 70°, in particular between 0° and 50°. The angle $\alpha 2$ can assume the values 0° or 50° or values of between 0° and 50° in particular of between 0° and 30°. In another exemplary embodiment, not illustrated, the angle $\alpha 1$ is smaller than the angle $\alpha 2$. In another exemplary embodiment, not illustrated, the angle $\alpha 1$ is equal to the angle $\alpha 2$. The second strut 810 connects the receptacle 803 to the housing 801, in particular to the housing wall 802.

The second strut 810 has a second strut end portion 813. The second strut end portion 813 is a web-like projection. The second strut end portion 813 is designed essentially as a triangular body. In another exemplary embodiment, not illustrated, the second strut end portion 813 is designed as a body in the form of a segment of a circle or has another streamlined shape. The second strut 810 likewise has an angle $\alpha 1$ and/or angle $\alpha 2$, not illustrated, in the same way as the first strut 809. In another exemplary embodiment, not illustrated, the angle $\alpha 1$ of the first strut is different from the angle $\alpha 1$, not illustrated, of the second strut 810. Likewise, the angle $\alpha 2$ of the first strut 809 is an angle different from the second angle $\alpha 2$, not illustrated, of the second strut 810.

The housing wall 802 has a housing wall portion 817 which, in particular, is of annular design. The first strut end portion 812 is formed essentially flush with the housing wall portion 817. The first strut 809 and/or the second strut 810 and/or the other struts 811 connect the housing wall 802 to the receptacle 803. The receptacle 803 has a receptacle bottom 804 and a receptacle wall 806. The receptacle bottom 804 has at least one reception orifice 805, in particular a multiplicity of reception orifices. Furthermore, the receptacle bottom 804 has at least one fastening orifice 807, in particular a multiplicity of fastening orifices 807, in particular four fastening orifices 807. A fan drive unit, not illustrated, in particular an electric motor, is connected to the receptacle 804 via the fastening orifices 807. The receptacle wall 806 is, at least in portions, of annular design. In the portion in which the fastening orifices 807 are located, the receptacle wall 806 has round embossings 808. The housing wall 802 has a housing wall orifice 814, through which a medium, in particular a gaseous medium, such as, for example, air, flows.

FIG. 9 shows a fan housing 901 which has a housing wall portion 902. A strut 903 has a strut end portion 904 which, in particular is of streamlined design. The strut end portion 904 is a web-like projection. The strut end portion 904 is arranged essentially in the direction of the media flow direction L of the flow medium, in particular the air.

FIG. 10 shows a fan housing portion. The fan housing portion 1001 has a housing wall portion 1002. A strut 1003 is connected to the fan housing portion 1001 via a strut end portion 1004. The strut end portion 1004 is a web-like projection. The strut end portion 1004 may be produced in one piece with the strut 1003. In another embodiment, the strut end portion 1004 is connected to the strut 1003. The strut end portion 1004 is of essentially streamlined design. The strut end portion 1004 is arranged essentially in the direction of a media flow direction L of a medium, in particular air. In the exemplary embodiment illustrated, the strut 1003 has an angle γ to the media flow direction L.

FIG. 11 shows a further perspective view of the fan housing from FIG. 8. Identical features are given the same reference symbols as in the preceding figures, in particular as in FIG. 8.

The medium, in particular air, flows through the fan system 1100 in the direction of the media flow direction L. The first strut 809 and/or the second strut 810 are arranged in such a way that the medium, in particular air generates essentially no vortices and, in particular, little noise at the first strut 809 and/or the second strut 810. The strut 809 is oriented essentially parallel to the media flow direction L1 in the region of the first strut 809. The second strut 810 is oriented essentially parallel to the media flow direction L2 of the medium, in particular air, in the region of the second strut 810.

FIG. 12 shows a perspective of a fan system 1200. Identical features are given the same reference symbols as in the preceding figures.

The fan system 1200 has a housing 1201 with a housing wall 1202. The housing wall 1202 is surrounded by a housing frame 1219. The housing frame 1219 has a housing frame edge 1221 which is formed essentially perpendicularly to the housing frame 1219. The housing frame edge 1221 has at least one orifice, not designated in any more detail. Furthermore, the housing frame edge 1221 has a rebate, not designated in any more detail, which at least in portions essentially runs around. The housing wall 1202 has at least one housing wall channel 1220, in particular a number of housing wall channels 1220. The housing wall channels 1220 extend from the housing frame 1219 in the direction of the housing wall orifice 1217. The housing wall channels 1220 run from the housing frame 1219 apart from one another in an essentially radiating manner. The housing wall 1202 comprises at least one housing wall portion 1218 which is formed essentially perpendicularly to the housing wall 1202. In the exemplary embodiment illustrated, the housing wall portion 1218 is designed as a ring element. The housing wall portion 1218 comprises the housing wall orifice 1217. In the exemplary embodiment illustrated, the housing wall orifice 1217 is designed as a circular or cylindrical orifice. In another version, not illustrated, the housing wall orifice 1217 has an oval shape or a rectangular shape or a shape composed of a combination of round and/or oval and/or rectangular elements.

A receptacle 1203, in particular for a fan drive unit, in particular an electric motor, is arranged essentially concentrically to the housing wall orifice 1217. The receptacle 1203 is designed essentially as a ring element. The receptacle 1203 has a reception orifice 1204 which, in the exemplary embodiment illustrated, is circular or cylindrical. In another exemplary embodiment, not illustrated, the reception orifice 1204 is of oval and/or rectangular design. In another exemplary embodiment, not illustrated, the orifice 1204 is designed as a combination of oval and/or circular and/or rectangular elements. The receptacle 1203 has a receptacle inner wall 1206 which is of essentially annular design. Furthermore, the receptacle 1203 has a receptacle outer wall 1205 which is designed essentially in the form of a tire casing. In another exemplary embodiment, not illustrated, the receptacle outer wall 1205 is designed as a tire casing of unshaped cross section or as a tire casing of v-shaped cross section.

In the exemplary embodiment illustrated the receptacle outer wall 1205 has, at least in portions, a radius, not designated in any more detail. In another exemplary embodiment, however, the radius may also be designed as a rectangular edge or an edge with an angle of 0° or 90° or with an angle of between 0° and 90°. The receptacle 1203 has at least one receptacle cutout 1207, in particular a number of receptacle cutouts 1207. Furthermore, the receptacle 1203 has a cable orifice 1208. In that portion of the receptacle 1203 in which the cable orifice 1208 is arranged, a cable duct 1213 touches the receptacle 1203 at least in portions. The cable duct is designed essentially as an open U-profile or as an open V-profile. At least one cable, in particular a number of cables, for supplying the fan drive unit are introduced through an orifice, not designated in any more detail, of the cable duct 1213 into the cable duct. The receptacle cutouts 1207 are arranged essentially in the region of the receptacle outer wall 1205.

A number of struts 1214, but at least one strut 1214, extends from the receptacle 1203 to the housing wall 1202 essentially in a star-shaped, in particular sunbeam-shaped manner. The struts 1214 are connected, at least in portions, to the receptacle 1203. The struts 1214 have at least one strut end portion 1215. The strut end portion 1215 of the at least one strut 1214 is connected, at least in portions to the housing wall 1202. The struts 1214 are designed essentially in such a way that the struts 1214, starting from the region of the receptacle 2003 taper in the radial direction toward the housing wall 1202. The struts 1214 have a radius at the transition into the strut end portion 1215. In the region of the strut end portion 1215, the struts run apart from one another again toward the housing wall 1202. The strut end portion 1215 is arranged essentially, at least in portions, at right angles to the strut 1214. The strut end portion 1215 is a web-like projection. The strut end portion 1215 has a first radius, not designated in any more detail, and a second radius, not designated in any more detail, which is greater than the first. A flow guide element 1216 is arranged on the strut end portion 1215 adjacently to the smaller inner radius, not designated in any more detail. In the exemplary embodiment illustrated, the flow guide element 1216 is produced in one piece with the strut end portion 1215. In another exemplary embodiment, not illustrated, the flow guide element 1216 is connected to the strut end portion 1215, in particular, by welding, soldering, adhesive bonding or another materially integral joining method.

In the exemplary embodiment illustrated, the flow guide element 1216 is arranged essentially flush with the housing wall portion 1218. The flow guide element 1216 has, at least in portions, an aerodynamic profile. At least one fan wheel 1209 is arranged essentially adjacently to the receptacle 1203 and essentially concentrically to the receptacle 1203. The fan wheel 1209 has a fan wheel ring 1211. The fan wheel ring 1211 is reinforced by means of at least one annular fan wheel strut 1212, in particular by means of a number of annular fan wheel struts 1212, which point from the fan wheel ring radially inward to a fan wheel axis, not designated in any more detail. At least one fan wheel vane 1210, in particular a number of fan wheel vanes 1210, in particular seven fan wheel vanes 1210 are arranged on an outer side, not designated in any more detail, of the fan wheel ring 1211. The fan wheel vanes 1210 are connected, at least in portions to the fan wheel ring 1211 by adhesive bonding, soldering, welding or another materially integral joining method. In the exemplary embodiment illustrated, the fan wheel vanes 1210 are produced in one piece with the fan wheel ring 1211. The fan wheel vanes 1210 have an aerodynamic shape.

The housing 1201 and/or the housing wall 1202 and/or the housing frame 1219 and/or the receptacle 1203 and/or the struts 1214 and/or the strut end portion 1215 are produced from a material with low density, in particular from plastic, and/or from aluminum and/or from a composite fiber material. The housing 1201 and/or the housing wall 1202 and/or the housing frame 1219 and/or the receptacle 1203 and/or the struts 1214 and/or the strut end portion 1215 are manufactured by means of a forming manufacturing method, in particular injection molding, for example plastic injection molding.

FIG. 13 shows a perspective view of another fan system 1300. Identical features are given the same reference symbols as in the preceding figures.

In contrast to FIG. 12, the strut end portions 1301 in FIG. 13 are designed differently. The strut end portion 1301, in particular the strut end portions 1301, have a clearance d with respect to the housing wall portion 1218. The strut end portion 1301 is a web-like projection. The strut end portions 1301 are designed as undercuts. The clearance d in the exemplary embodiment illustrated, assumes values $d \geqq 0$ mm, in particular 5 mm$\leqq d \leqq$14 mm, in particular 5 mm$\leqq d \leqq$12 mm. The strut end portion 1301 has at least one flow guide element 1302. The flow guide element 1302 has an aerodynamic shape. In the exemplary embodiment illustrated, the flow guide element 1302 is produced in one piece with the strut end portion 1301. In another exemplary embodiment, not illustrated, the flow guide element 1302 is connected to the strut end portion 1301 in a materially integral manner, in particular by adhesive bonding, soldering, welding, etc.

The strut end portions 1301 and/or the flow guide elements 1302 are manufactured from a material with low density, in particular from plastic and/or from aluminum and/or from another metal and/or from a composite fiber material.

FIG. 14 shows a perspective view of another fan system 1400. Identical features are given the same reference symbols as in the preceding figures.

The fan system 1400 has at least one strut 1214, in particular a number of struts 1214. In contrast to FIGS. 12 and 13, the housing wall 1202 has at least one housing wall cutout 1403 adjacent to the strut end portion 1401, in particular adjacent to the strut end portions 1401. The strut end portion 1401 is a web-like projection. In another exemplary embodiment, not illustrated, the housing wall 1202 has a plurality of housing wall cutouts adjacent to the strut end portions 1401.

The housing wall cutout 1403 is designed as a groove which has essentially the same width as the strut end portion 1401. In another exemplary embodiment, not illustrated, the housing wall cutout 1403 is designed as a groove which has a smaller width or a larger width than the strut end portion 1401. The strut end portion 1401 is arranged with a clearance e from housing wall portion 1218. The clearance e assumes values $e \geqq 0$ mm, in particular values of 0 mm$\leqq e \leqq$14 mm, in particular 4 mm$\leqq e \leqq$12 mm, in particular 6 mm$\leqq e \leqq$10 mm. The strut wall portion 1218 has a rounding 1404 in the portion in which it merges into the housing wall 1202. The rounding has a radius, not designated in any more detail. The radius, not designated in any more detail assumes values $\geqq 0$ mm, in particular values 1 mm to 10 mm, in particular values 2 mm to 5 mm or values of 10 mm to 15 mm. In another exemplary embodiment, the rounding 1404 may be designed as an edge.

FIG. 15 shows, as a detail G, an illustration of a strut end portion 1500. Identical features are given the same reference symbols as in the preceding figures.

The strut end portion 1500 has a strut end portion wall surface 1504. The strut end portion 1500 is a web-like projection. In the region of the transition of the strut portion 1505 into the strut end portion 1500, the wall surface of the strut end portion 1504 has a radius. Furthermore, the strut end portion 1500 has at least one flow guide element 1501. The flow guide element has a radius 1506 in the transitional portion of the strut end portion into the flow guide element 1501. The flow guide element 1501 has a wall 1502. The wall 1502 has an angle $\sigma$ with respect to the strut portion 1505. In the exemplary embodiment illustrated, the angle $\sigma$ is essentially 90°. In another exemplary embodiment, not illustrated, the angle $\sigma$ assumes values of between 30° and 130°, in particular values of between 70° and 100°.

The features of the various exemplary embodiments can be combined with one another in any desired way. The invention can also be used for fields other than those shown.

What is claimed is:

1. A fan system for a heat exchanger comprising:

at least one fan wheel;

at least one fan drive unit configured to drive the fan wheel;

at least one receptacle for the fan drive unit;

a housing including at least one housing wall; and a plurality of struts, configured to be arranged between at least one heat exchanger and the fan wheel, that connect the receptacle to the housing wall, wherein at least one strut from the plurality of struts has at least one strut portion arranged essentially in a direction of a flow medium entering the fan system, and wherein the at least one strut has at least one strut portion that forms an acute angle $\alpha$ with respect to a fan wheel axis direction.

2. The fan system according to claim 1, wherein at least one housing orifice is arranged eccentrically with respect to the housing.

3. The fan system according to claim 1, wherein at least one housing orifice is arranged centrally with respect to the housing.

4. The fan system according to claim 1, wherein at least one strut portion of the at least one strut forms an angle $\beta$ with respect to a plane which is formed by a direction radial to the fan wheel axis direction and by the fan wheel axis direction.

5. The fan system according to claim 1, wherein a strut end portion of the at least one strut is designed as a web-like projection, in such a way that the strut end portion forms an angle $\gamma$ with respect to a plane which is formed by a direction radial to the fan wheel axis direction and by the fan wheel axis direction.

6. The fan system according to claim 5, wherein the housing wall has in each case, at least one cutout adjacent to the at least one strut end portion.

7. The fan system according to claim 5, wherein the strut end portion has a clearance with respect to a housing wall portion.

8. The fan system according to claim 5, wherein the strut end portion is arranged flush with a housing wall portion.

9. The fan system according to claim 5, wherein the at least one strut end portion has at least one flow guide element.

10. A heat exchanger module with at least one heat exchanger and at least one fan system according to claim 1.

11. A method for manufacturing the fan system according to claim 1, comprising manufacturing the fan system of claim 1 by a forming manufacturing method, wherein the forming manufacturing method is injection molding.

12. The method for manufacturing the heat exchanger module according to claim 10, comprising manufacturing the fan system by a forming manufacturing method, wherein the forming manufacturing method is injection molding.

* * * * *